US011434706B1

(12) United States Patent
Fontaine et al.

(10) Patent No.: US 11,434,706 B1
(45) Date of Patent: Sep. 6, 2022

(54) PIPE HANDLING ASSEMBLY FOR USE IN HORIZONTAL DIRECTIONAL DRILLING

(71) Applicant: 2233381 Alberta Corp., Devon (CA)

(72) Inventors: Robbie S. Fontaine, Wetaskiwin (CA); Daniel R. Page, Westlock (CA); Gustaaf M. Rus, Spruce Grove (CA)

( * ) Notice: Subject to any disclaimer, the term of this patent is extended or adjusted under 35 U.S.C. 154(b) by 0 days.

(21) Appl. No.: 17/229,014

(22) Filed: Apr. 13, 2021

(51) Int. Cl.

| | |
|---|---|
| ***E21B 15/04*** | (2006.01) |
| ***E21B 19/086*** | (2006.01) |
| ***E21B 19/16*** | (2006.01) |
| ***E21B 3/02*** | (2006.01) |
| ***E21B 19/15*** | (2006.01) |
| *E21B 7/04* | (2006.01) |

(52) U.S. Cl.
CPC ..... *E21B 19/164* (2013.01); *E21B 3/022* (2020.05); *E21B 19/15* (2013.01); *E21B 7/046* (2013.01)

(58) Field of Classification Search
CPC ..... E21B 15/04; E21B 15/045; E21B 19/20; E21B 7/046; E21B 19/086; E21B 19/24
See application file for complete search history.

(56) References Cited

U.S. PATENT DOCUMENTS 3,994,350 A * 11/1976 Smith ..... E21B 19/084 173/147
4,078,617 A * 3/1978 Cherrington ..... E21B 7/20 173/186
4,405,022 A * 9/1983 Will ..... E21B 19/20 175/85
5,803,189 A * 9/1998 Geldner ..... E21B 19/084 175/203
6,095,501 A * 8/2000 Vatne ..... E21B 19/084 254/386
6,845,825 B2 * 1/2005 Bischel ..... E21B 19/20 175/85
8,949,416 B1 * 2/2015 Barnes ..... E21B 44/00 709/224
9,540,891 B2 * 1/2017 Milivojevic ..... E21B 19/20
10,119,346 B2 11/2018 Randall et al.
2002/0062994 A1 * 5/2002 Watanabe ..... E21B 19/146 175/85
2003/0132030 A1 7/2003 Tompkins
2013/0028665 A1 * 1/2013 Cherrington ..... F16L 1/028 405/184
2015/0136420 A1 * 5/2015 Tengliden ..... E21B 17/042 166/77.51
2015/0259993 A1 9/2015 Patel et al.
2016/0097245 A1 * 4/2016 Jelgert ..... E21B 19/161 166/77.51
2020/0392798 A1 * 12/2020 Cutler ..... E21B 3/02

* cited by examiner

*Primary Examiner* — Kipp C Wallace
(74) *Attorney, Agent, or Firm* — Bushman Werner, P.C.

(57) ABSTRACT

A system for handling drill pipe on the exit side of the borehole in horizontal directional drilling operations. The system pulls the drill string out of the borehole and uses a top drive and pipe wrench to disconnect the individual segments of drill pipe from the drill string. Pipe gripping arms lift the disconnected drill pipe segment away from the rest of the drill string and release it into a nearby pipe rack. The components of the system are collapsible and can nest in one another during transport.

14 Claims, 13 Drawing Sheets

PIPE HANDLING ASSEMBLY FOR USE IN HORIZONTAL DIRECTIONAL DRILLING

FIELD OF THE INVENTION

The present invention relates to horizontal directional drilling, more particularly, to handling of drill pipe on the exit side of a borehole.

BACKGROUND OF THE INVENTION

Horizontal directional drilling, also sometimes referred to as directional drilling, is a method of installing pipelines, utility lines or the like without digging a trench. For example, this method is particularly useful when the underground pipelines must cross beneath a river, roadway, building, or other obstacle which cannot be dug up to allow installation of the pipeline.

In horizontal directional drilling (HDD), a borehole is drilled out along a predetermined path using a drill bit pulling a string of drill pipe. A transmitter or steering tool located near the drill head sends a signal to the operator giving the exact coordinates of the drill head. As the drill head travels further, additional lengths of drill pipe are added to the drill string. Drilling fluid or drilling mud is used to help stabilize the borehole and lubricate and cool the drill bit. When the drill bit reaches the exit point of the borehole, pipe handling equipment positioned at the exit side is used to pull the drill string out of the borehole through the exit point. If desired, reamers can be attached to the drill string and pulled through the borehole to enlarge the diameter of it. This process may be repeated multiple time with reamers of gradually increasing size. The pipeline, utility cable, or the like which is to ultimately be installed in the borehole can be connected to the drill string and pulled through the borehole.

At the exit side of the borehole, the successive lengths of drill pipe must be removed from the drill string as they exit the borehole. The prior art is replete with examples of pipe handling devices for accomplishing this task. U.S. Pat. No. 10,119,346 discloses a vise assembly suspended from the arm of a hydraulic machine, similar in nature to a hydraulic excavator or material handler. The operator must ensure that the machine is carefully positioned, that the vise assembly is at the correct height and alignment with the drill string, and that the correct amount of force is applied to the drill string. US Publication 2003/0132030 discloses a skid-mounted torque wrench and spinning unit for making and breaking connections. U.S. Pat. No. 6,364,011 discloses a system for connecting and disconnecting horizontal tubulars. All references cited in this paragraph are incorporated herein by reference for all purposes.

SUMMARY OF THE INVENTION

In one aspect, the present invention relates to a system for handling drill pipe on the exit side of the borehole in HDD operations. The system allows for a hands-off pipe handling, maintains the drill string in the proper alignment and position during pipe handling, and achieves the necessary tension on the drill string to pull it through the borehole. The system pulls the drill string and uses a top drive and pipe wrench to disconnect the individual segments of drill pipe from the drill string.

In another aspect, the present invention relates to a system for handling drill pipe on the exit side of the borehole in HDD operations, the system can be easily transported, with components that are collapsible and which can nest in one another during transport.

These and further features and advantages of the present invention will become apparent from the following detailed description, wherein reference is made to the figures in the accompanying drawings.

DETAILED DESCRIPTION OF PREFERRED EMBODIMENTS

Figure 1:
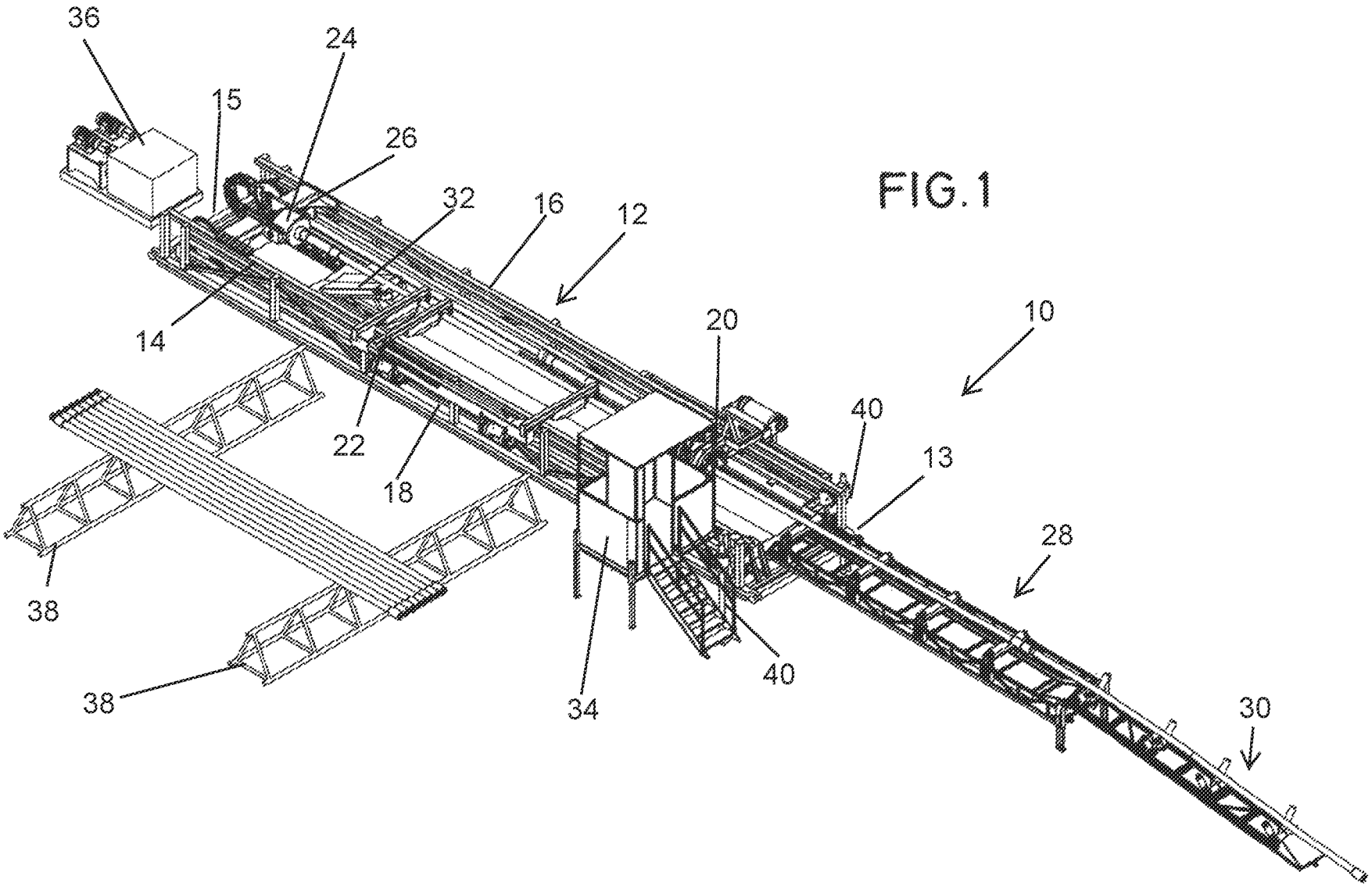
FIG. 1 is a perspective view of the system of the present invention.
Figure 2:
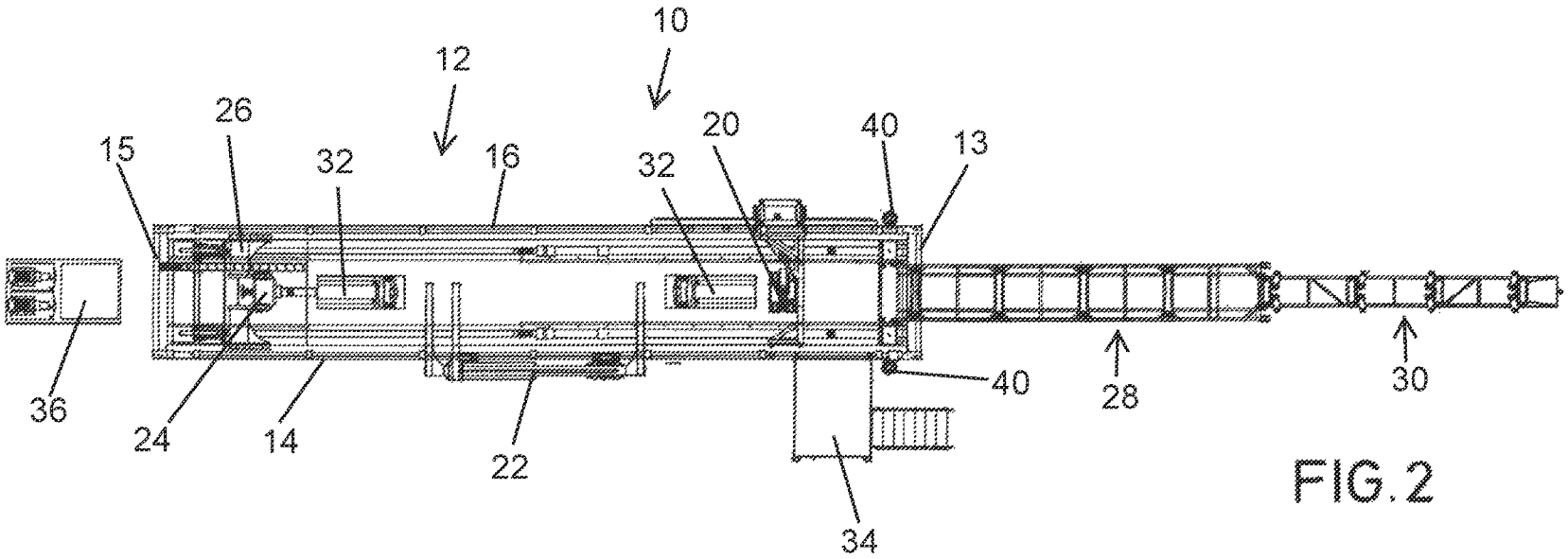
FIG. 2 is a top view of the system of the present invention.
Figure 3:
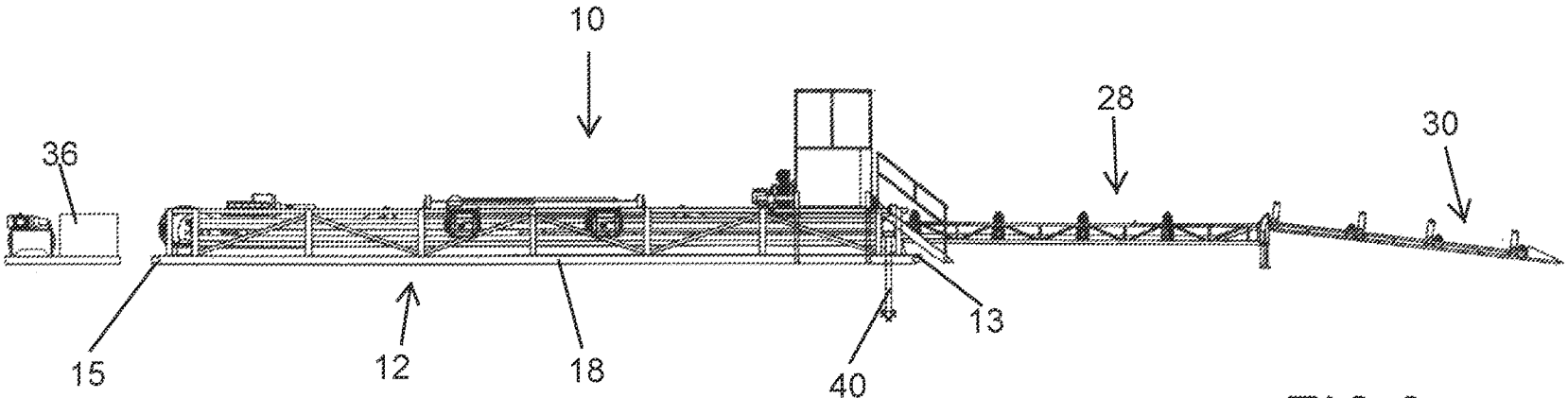
FIG. 3 is a side elevational view of the system of the present invention.

Turning to FIGS. 1-3 there is shown generally as 10 the pipe handling system of the present invention. The system 10 includes an elongate skid 12 having first and second side walls 14 and 16 attached to a base 18. Skid 12 has a first end 13 and a second end 15. A pipe wrench 20 is pivotally mounted on wall 16. A pipe gripping arm assembly 22 is pivotally mounted on wall 14. Top drive 24 is mounted on a drive carrier system 26 which, as will be discussed more fully below, is operable to move longitudinally along skid 12. Extending out from first end 13 of skid 12 is a feed frame 28. Extending from feed frame 28 is ramp 30. A plurality of pipe support plates 32 are mounted in the base 18 of skid 12. Mounted on frame wall 14 is an operator's cabin 34. A mud pumping unit 36 is positioned just outside skid 12, near top drive assembly 24. Pipe racks 38 are positioned alongside skid 12 near pipe gripping assembly 22. A plurality of screw piles 40 are affixed to walls 14 and 16 near one end of skid 12. Screw piles 40 can extend into the ground to hold the system 10 in place. The details and operation of the components shown in FIGS. 1-3 will be discussed more fully below.

Figure 4:
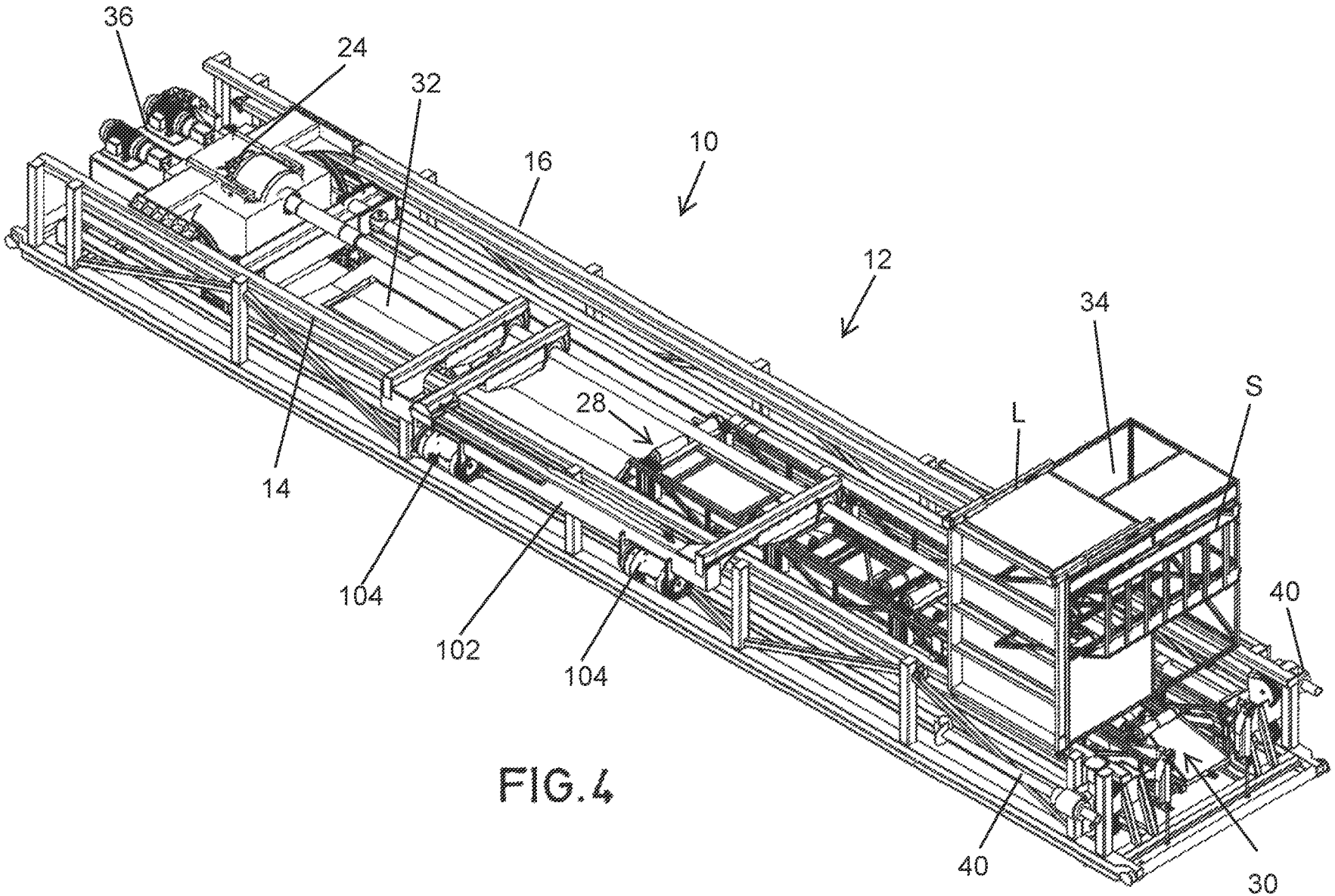
FIG. 4 is a perspective view of the system of the present invention in transport mode.
Figure 5:
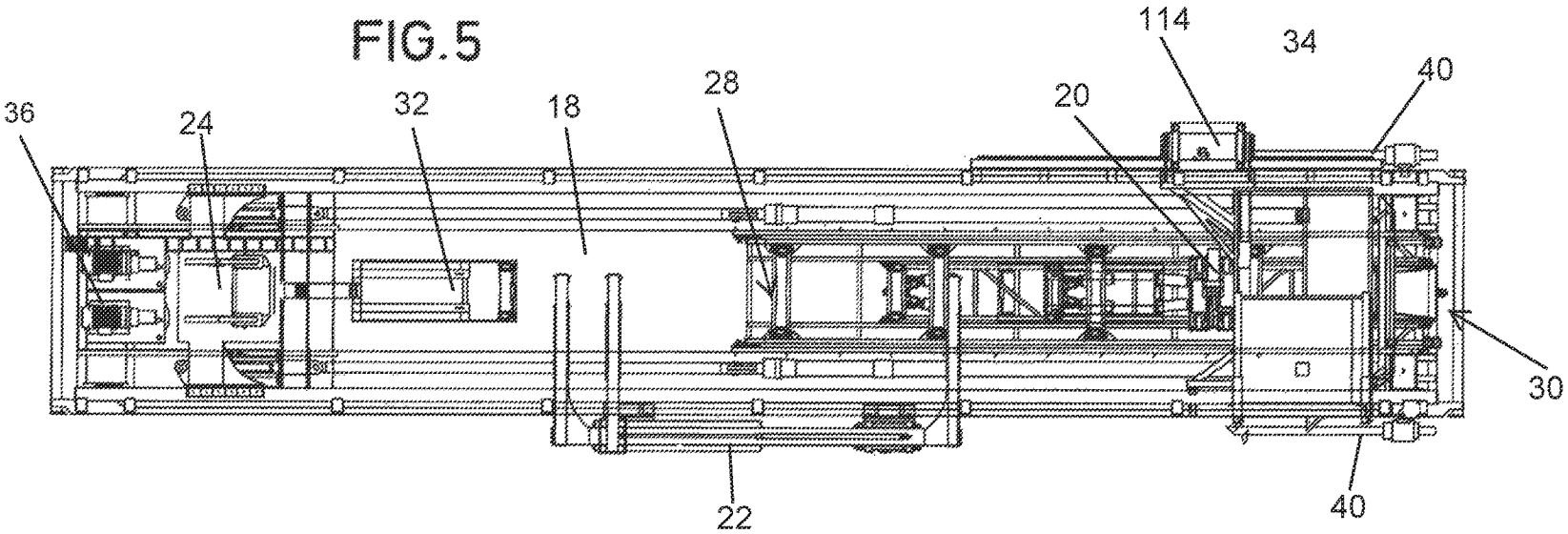
FIG. 5 is a top view of the system of the present invention in transport mode.
Figure 6:
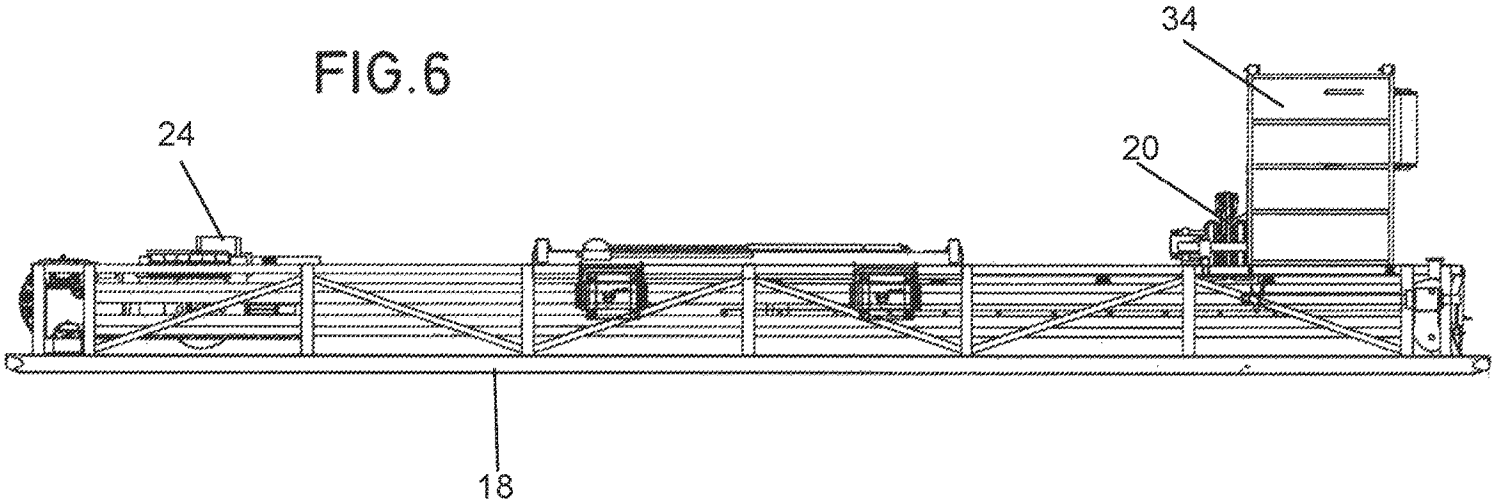
FIG. 6 is a side elevational view of the system of the present invention in transport mode.
Figure 7:
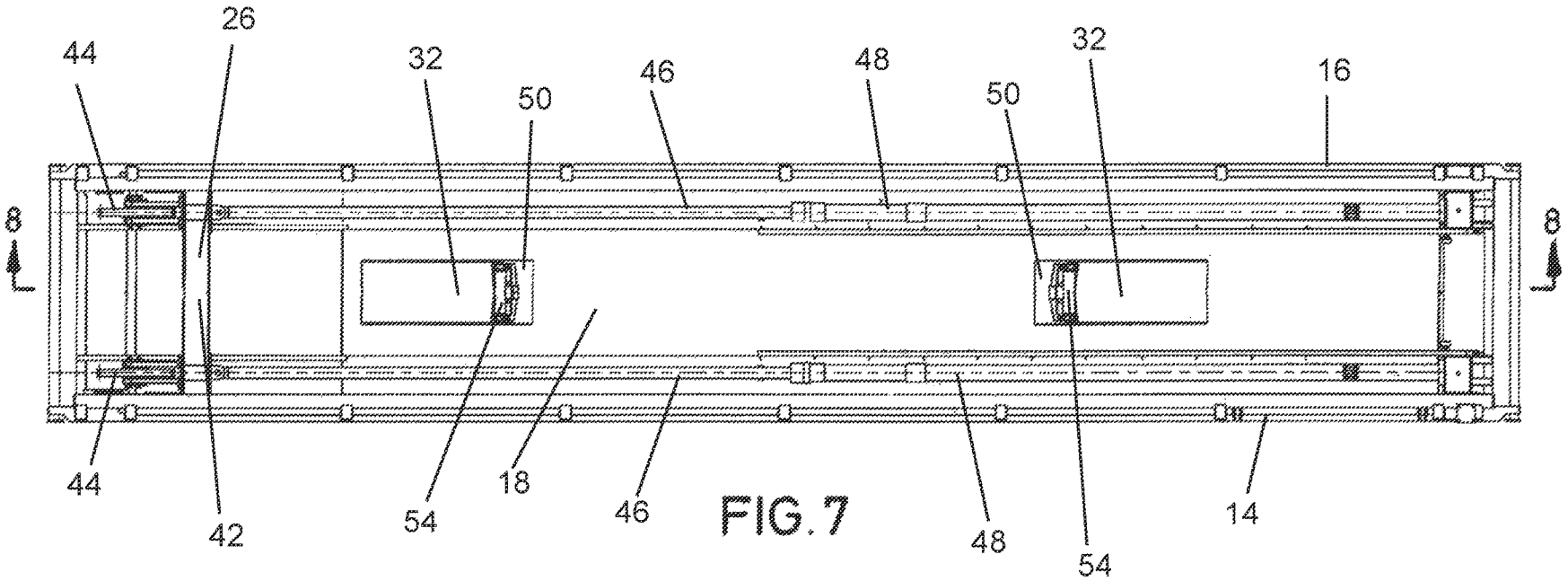
FIG. 7 is a top view of the pipe support portion of the present invention.

Turning to FIGS. 4-6 there is shown system 10 in transport mode. As best seen in FIG. 4, all of the components of system 10, except for the separate pipe racks, can fit onto skid 12. Ramp 30 fits is slidably received within feed frame 28. Feed frame 28 (and ramp 30), in turn is slidably received within skid 12. Operator's cabin 34 pivots around its mount on wall 14 and rests sideways atop skid 12. The stairs S and legs L of cabin 34 are foldable and collapsible, respectively, to ensure the footprint of the system 10 is reduced. Screw piles 40 are pivoted to extend along the length of walls 14 and 16. Mud pumping unit 36 fits on skid 12 behind top drive 24. It will be appreciated that connections, fasteners, tiedowns, or the like can be employed throughout system 10 to hold the components in position during transport. Such fastening components are not discussed herein, but are well understood to those skilled in the art. It is well known that public highways have restrictions regarding size and weight of loads being transported. In transport mode, the footprint of system 10 is greatly reduced and, as such, system 10 can be loaded onto a flatbed truck, trailer, or other transport means and transported along public highways.

Figure 8:
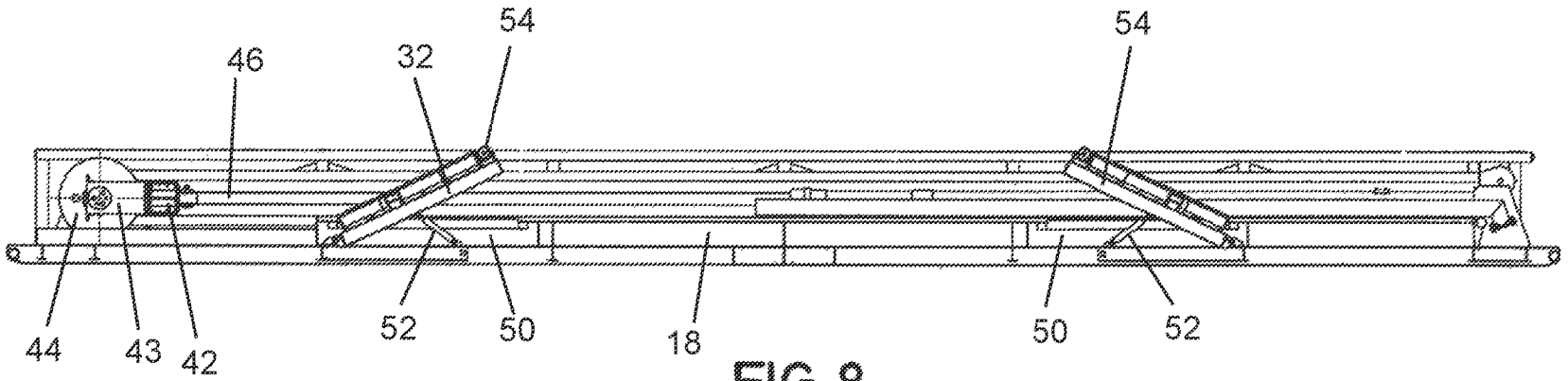
FIG. 8 is a view taken along the lines 8-8 of FIG. 7.
Figure 9:
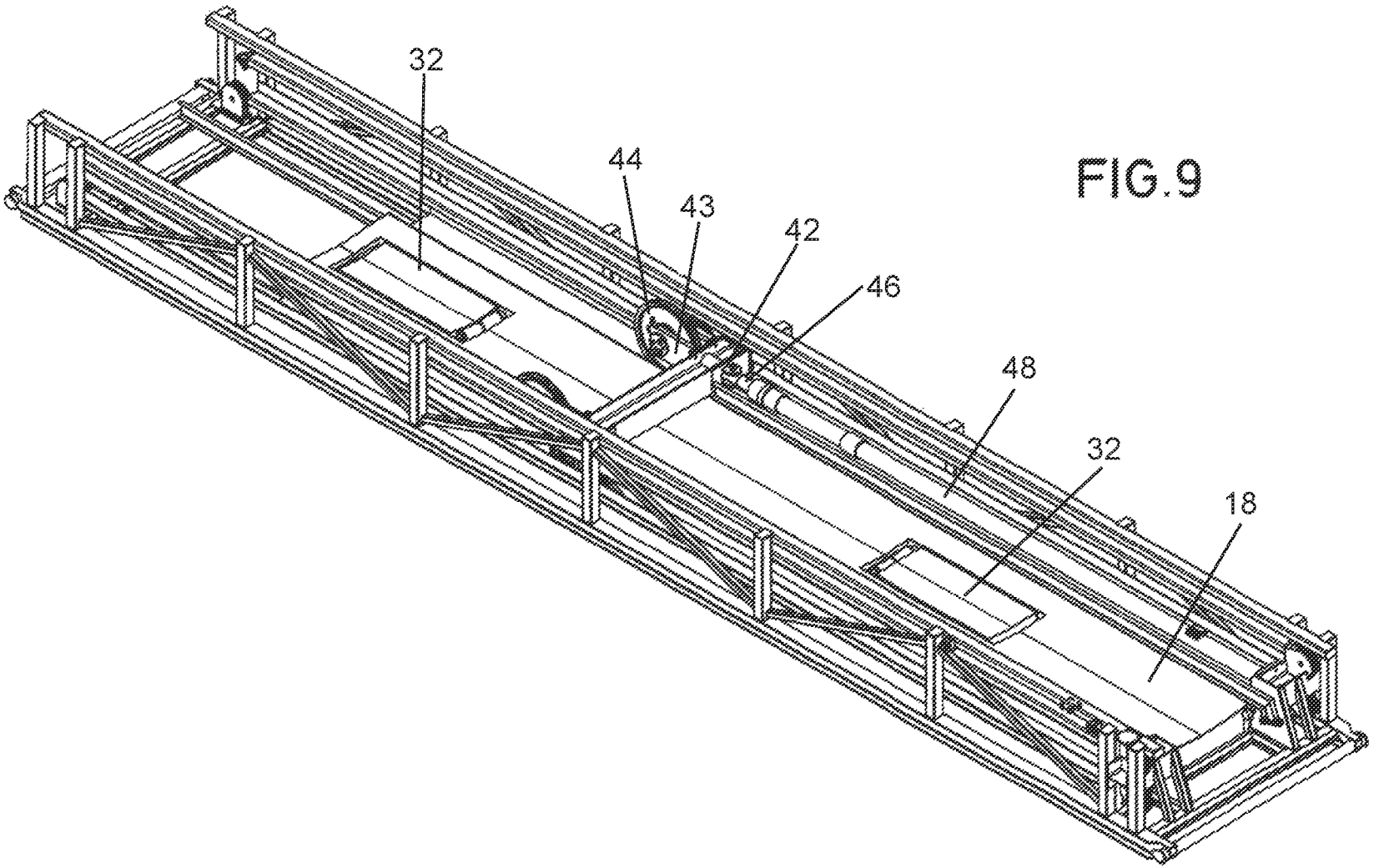
FIG. 9 is a perspective view of the pipe support portion of the present invention, showing the pipe supports lowered.
Figure 10:
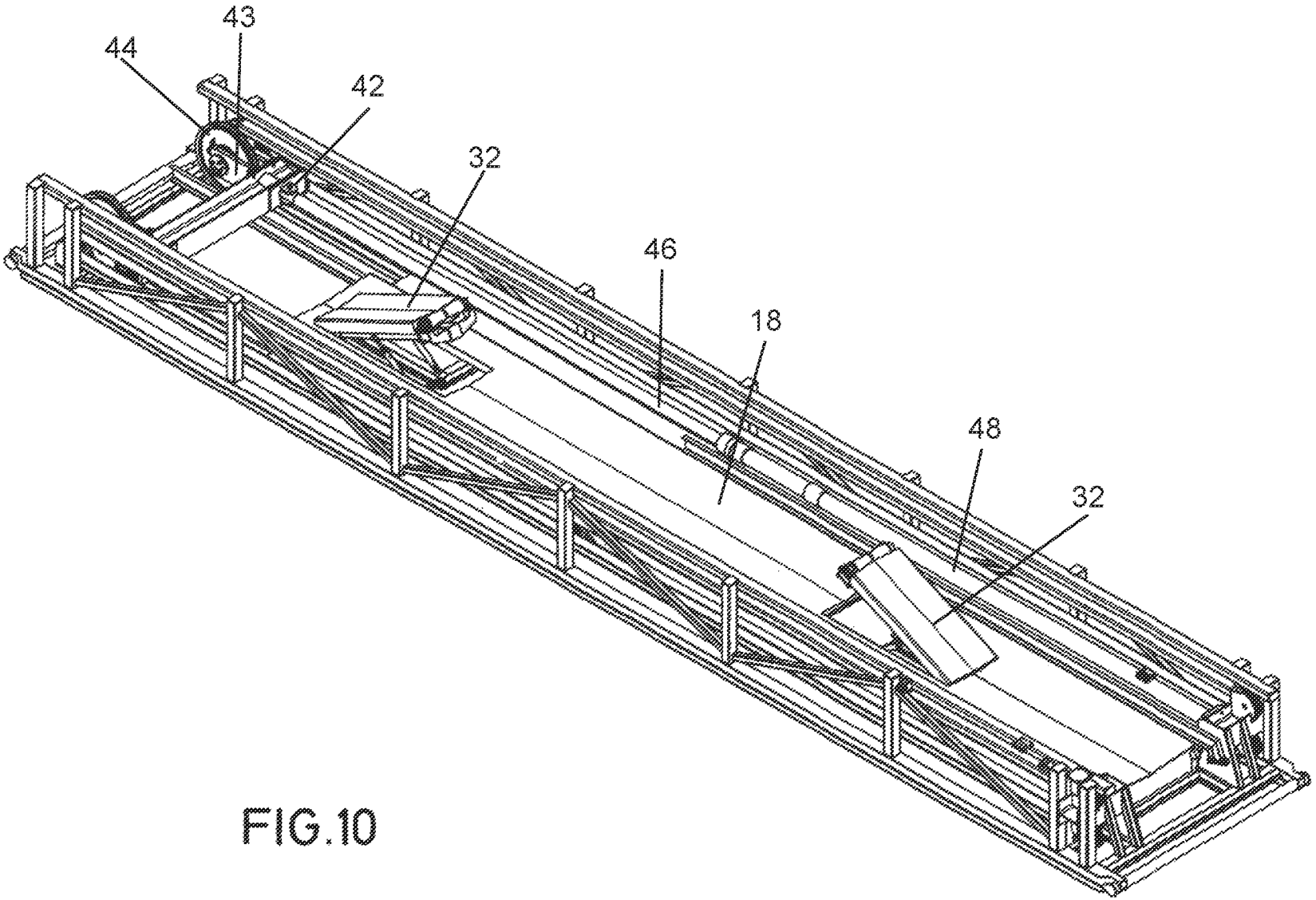
FIG. 10 is a view similar to FIG. 9, but showing the pipe supports lifted.

Turning now to FIGS. 7-10, there is shown the top drive carrier system 26 and pipe support plates 32. Top drive carrier system 26 includes drive mount bar 42 to which top drive 24 is mounted, though to better see the various components, top drive 24 is not depicted in FIGS. 7-10. Nevertheless it will be understood that top drive 24 is attached to top drive carrier system 26 such that movement of mount bar 42 indicates concomitant movement of top drive 24. Mount bar 42 is connected to a pair of piston rods 46 which extend from respective piston cylinders 48. Piston rods 46 are connected to and driven by pistons (not shown) within piston cylinders 48. Pistons (not shown) and piston rods 46 can be actuated or driven by hydraulic pressure, pneumatic pressure, electronics, or other means well known to those skilled in the art. A pair of wheels 44 is positioned alongside mount bar 42, opposite rods 46. Each of wheels 44 is rotatably mounted within a clevis 43 which is attached to mount bar 42. Wheels 44 provide support and ease movement of mount bar 42 and top drive 24 along the length of skid 12. As best seen in FIG. 9, when piston rods 46 are retracted into piston cylinders 48, mount bar 42 (and hence top drive 24, not shown) are pulled lengthwise along skid 12. As best seen in FIG. 10, when rods 46 are fully extended, mount bar 42 (and top drive 24) are driven back along skid 12 to the position proximal end 15.

As seen in FIGS. 8 and 10, pipe support plates 32 extend upward from base 18 at an angle. Pipe support plates 32 can be lowered to nest in recesses 50 in base 18 (see FIG. 9). As depicted in the drawings, pipe support plates 32 are raised and lowered by means of arms 52. Arms 52 can be hydraulically, pneumatically, or electronically controlled. Each of support plates 32 has a set of idler rollers 54 along one end to assist with the movement of pipes, drill string, or other tubulars along the length of skid 12. It will be understood that the exact means of raising and lowering support plates 32 can vary. The ability of the support plates 32 to be lowered into recesses 50 is important for allowing top drive carrier system 26 to move along the length of skid 12. As seen in FIGS. 9 and 10, when mount bar 42 is moved away from end 15, support plates 32 are lowered into base 18. This allows mount bar 42 (and top drive 24) to easily pass over the top of support plates 32. When mount bar 42 (and top drive 24) are positioned back at end 15, support plates 32 are raised to support the drill string, pipe, or other tubulars being handled by the system of the present invention. When lowered into recesses 50, support plates 32 are preferably substantially flush with the surface of base 18. It will be appreciated that plates 32 can be controlled together or independently of each other (such that one plate 32 may be raised while the other is lowered).

Turning now to FIGS. 11-15 there is shown feed frame 28 and ramp 30. Feed frame 28 is an elongate frame formed from first and second frame walls 60 and 62. Feed frame 28 has a first end 61 and a second end 63. A plurality of idler rollers 64 are mounted to walls 60 and 62, idler rollers 64 being spaced along the length of feed frame 28. Positioned at first end 61 are legs 66. Legs 66 are adjustable in height which allows for the frame to be positioned on varying levels of ground and also ensures that legs 66 can be retracted during storage. The means of adjusting the height can include various ways well known to those skilled in the art, including, but not limited to, the use of detents, threaded tighteners, or the like.

Figure 11:
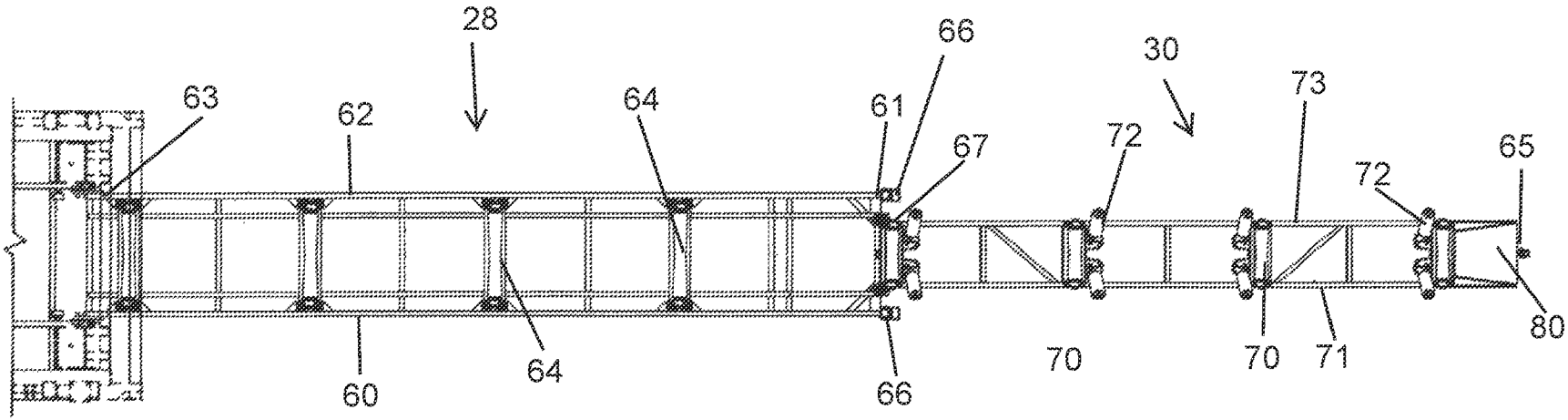
FIG. 11 is a top view of the feed portion of the present invention.
Figure 12:
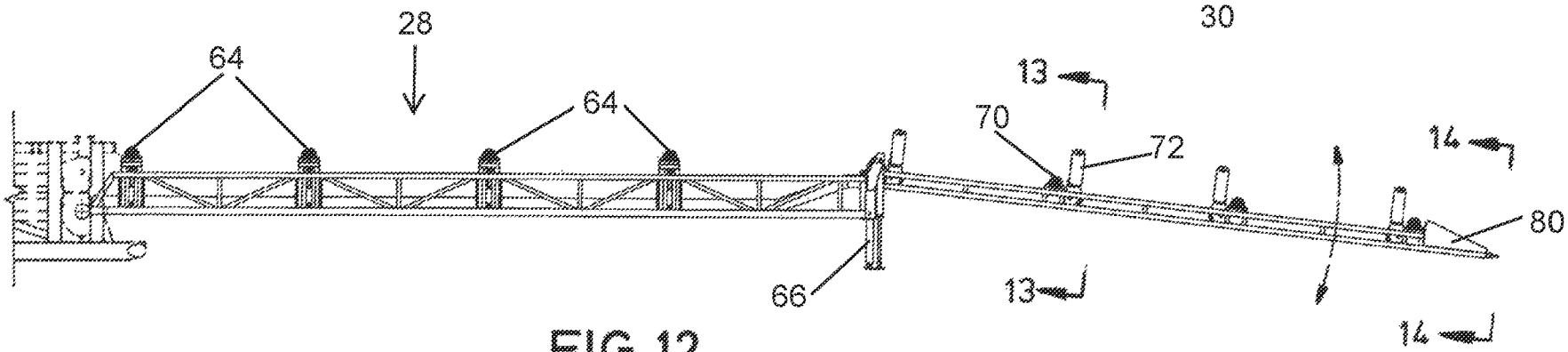
FIG. 12 is a side elevational view of the feed portion of the present invention.

As best seen in FIGS. 11 and 12, extending from first end 61 of feed frame 28 is ramp 30. Ramp 30 is slidably and pivotally connected to frame 28. Again, this ensures that ramp 30 can rest on varying ground levels, and, as will be shown more fully hereafter, allows ramp 30 to be retracted during transport mode. Ramp 30 is made of first and second ramp walls 71 and 73. Ramp 30 has first end 65 and second end 67. An inclined nosepiece 80 is disposed on first end 65 of ramp 30. Mounted on walls 71 and 73 are idler rollers 70. Mounted between walls 71 and 73, and positioned near each idler roller 70 are crossbeams 75. Mounted to each crossbeam 75 are a pair of diagonal rollers 72.

Figure 13:
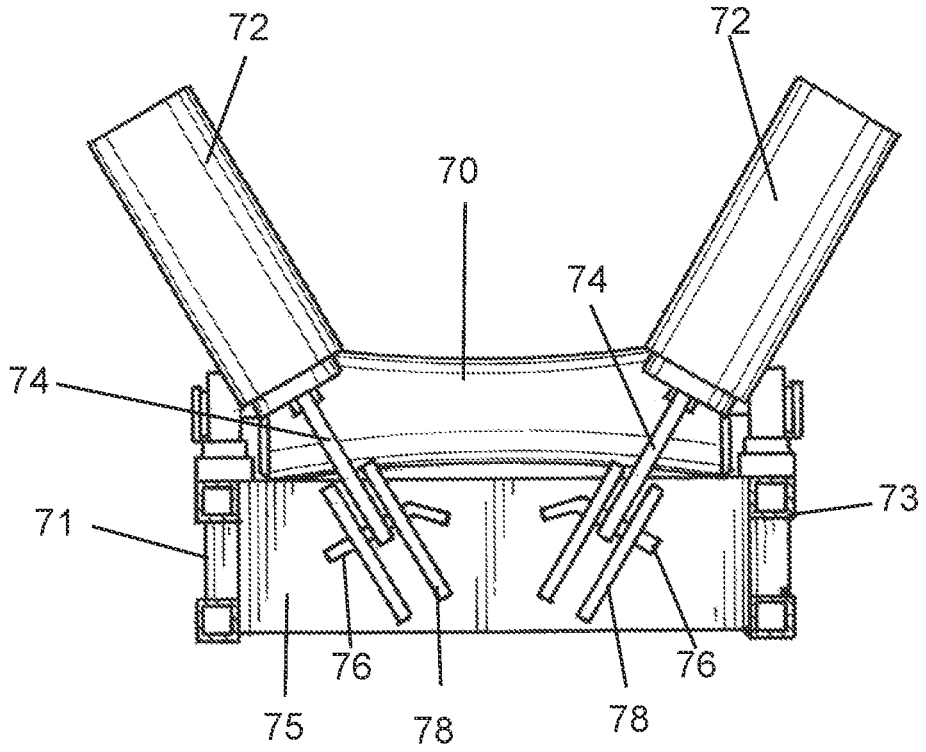
FIG. 13 is a view taken along the lines 13-13 of FIG. 12.

With reference now to FIG. 13, there is shown the mounting of diagonal rollers 72 on crossbeam 75. A pair of supports 78 are affixed to crossbeam 75. Each roller 72 is mounted on a stem 74. Supports 78 and stem 74 all have holes extending therethrough. A pin 76 extends through the holes in supports 78 and stem 74. Stem 74 can pivot around pin 76 which allows diagonal rollers 72 to be folded down during transport mode.

Figure 14:
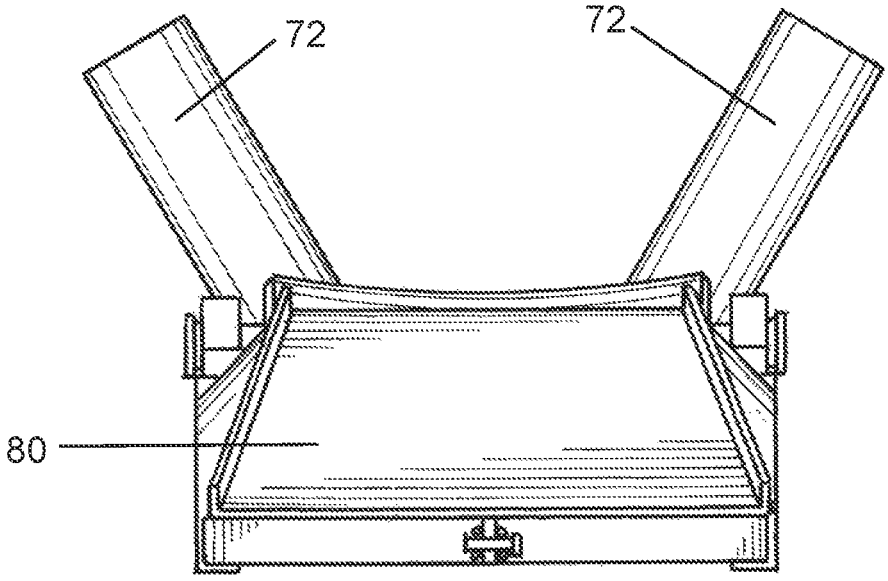
FIG. 14 is a view taken along the lines 14-14 of FIG. 12.

FIG. 14 is an end-on view of ramp 30.

Figure 15:
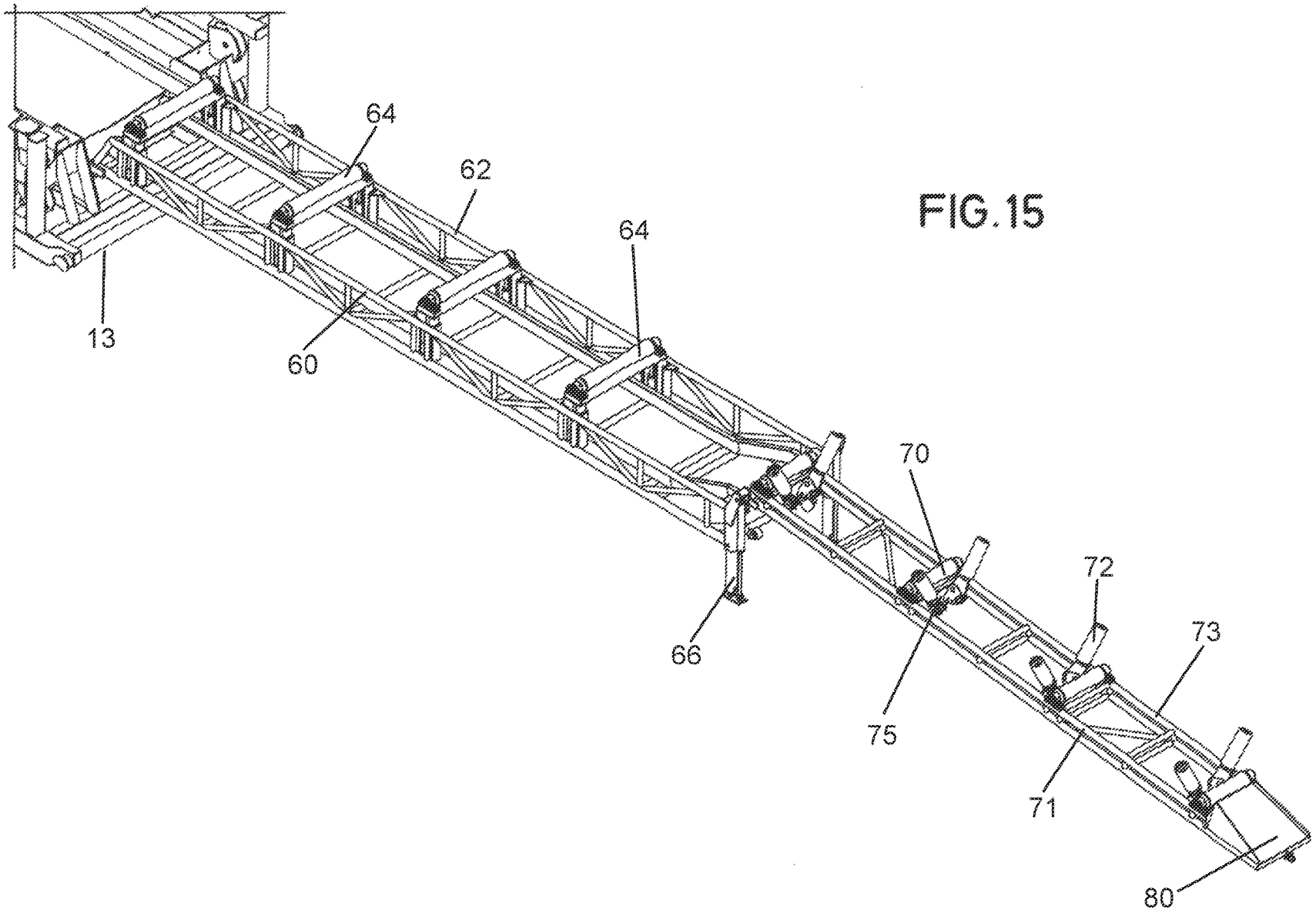
FIG. 15 is a perspective view of the feed portion of the present invention.
Figure 16:
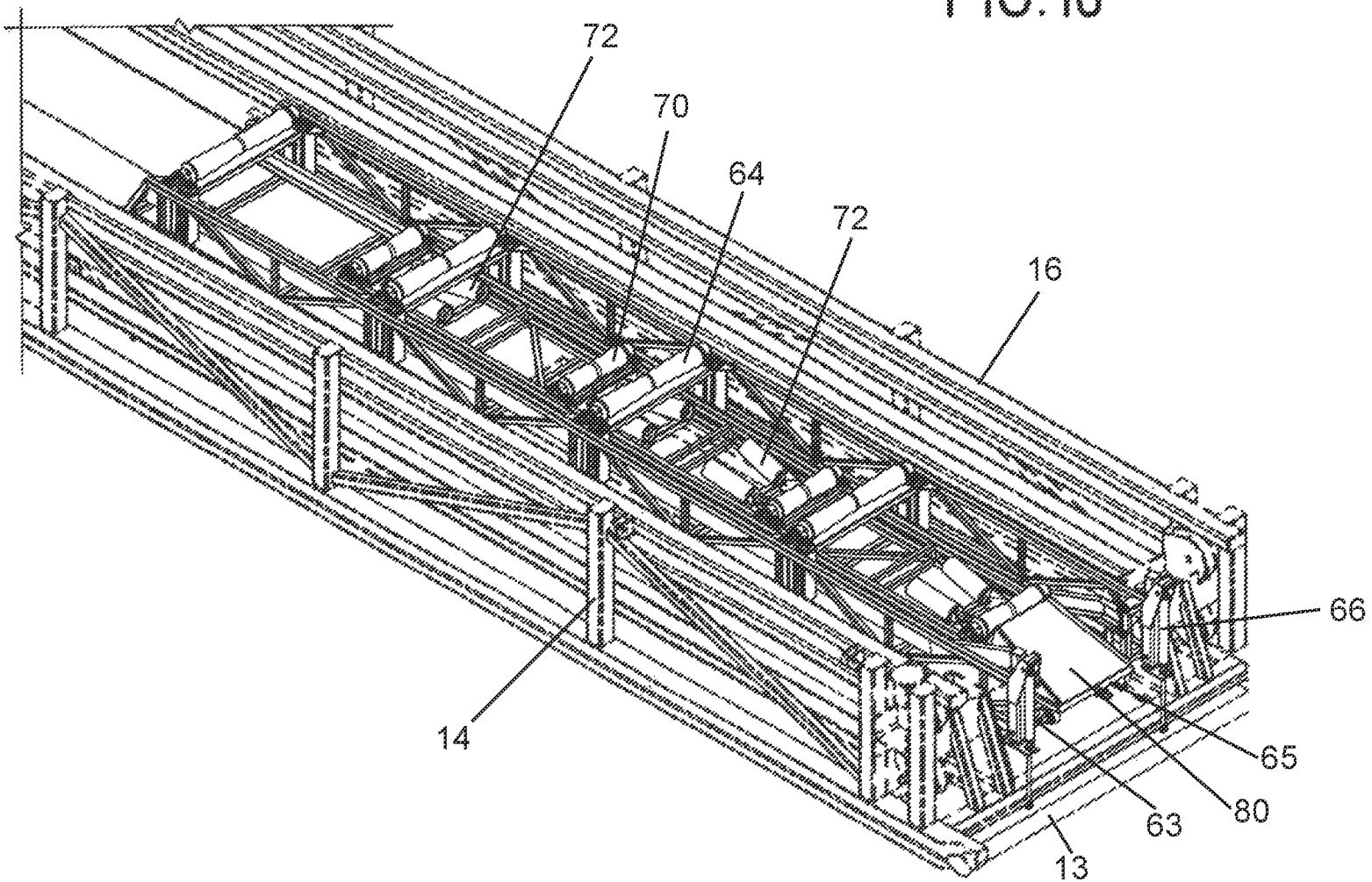
FIG. 16 is a perspective view of the feed portion of the present invention in transport mode.
Figure 17:
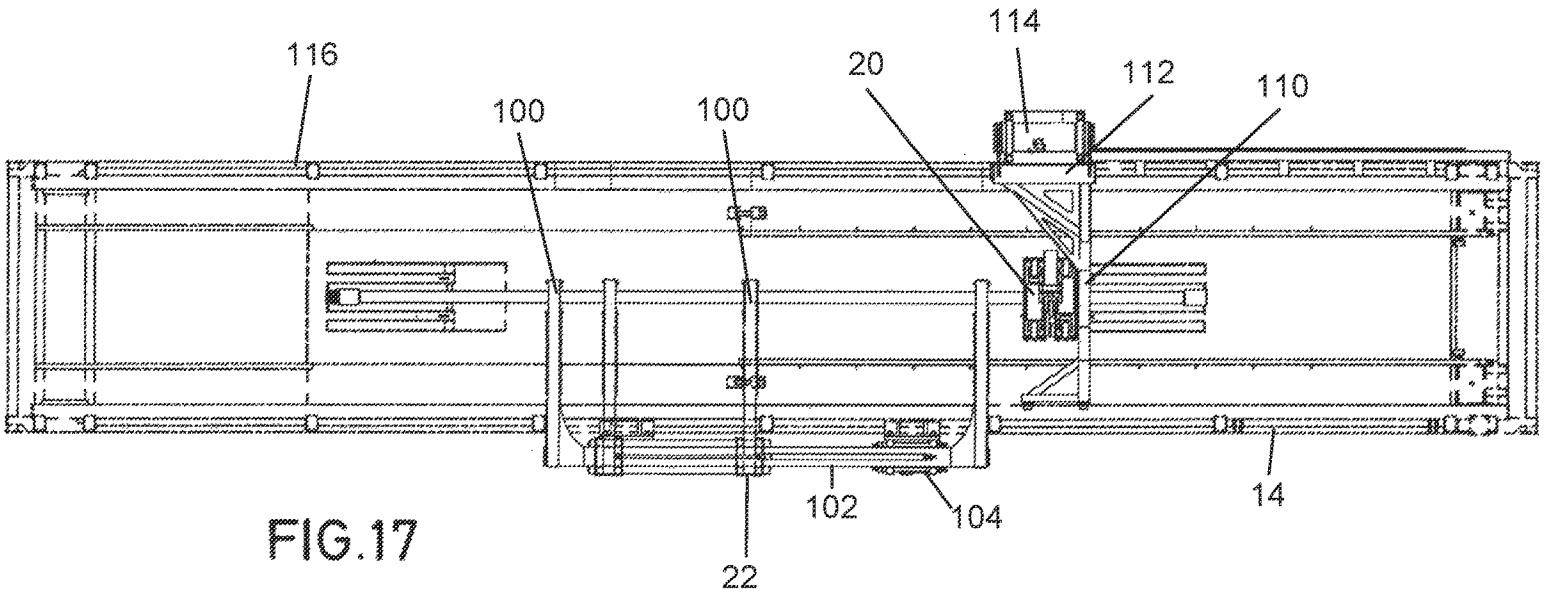
FIG. 17 is a top view of the pipe arms and wrench of the present invention.
Figure 18:
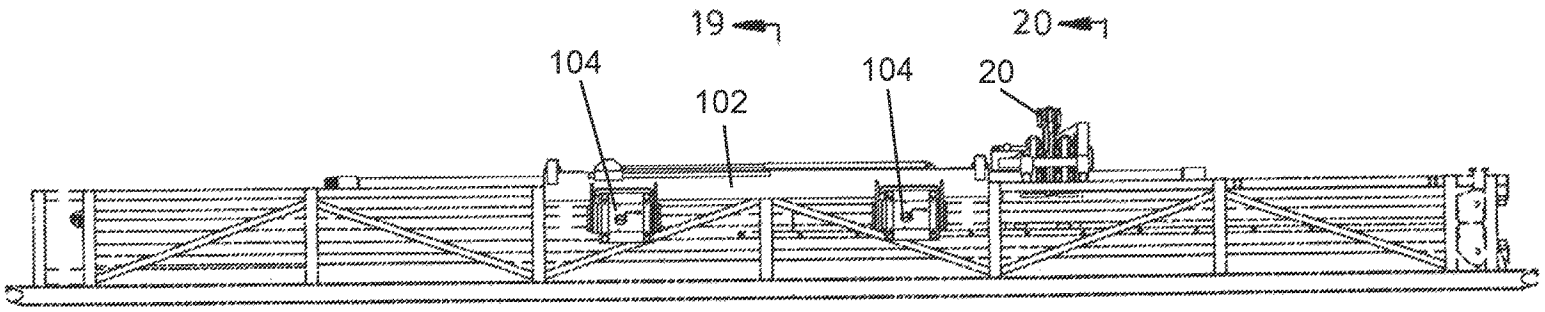
FIG. 18 is a side elevational view of the pipe arms and wrench of the present invention.
Figure 19:
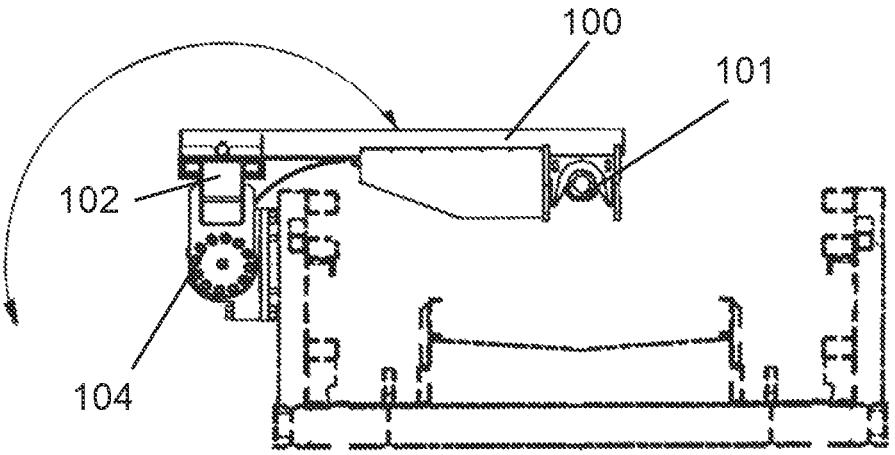
FIG. 19 is a view taken along the lines 19-19 of FIG. 18.
Figure 20:
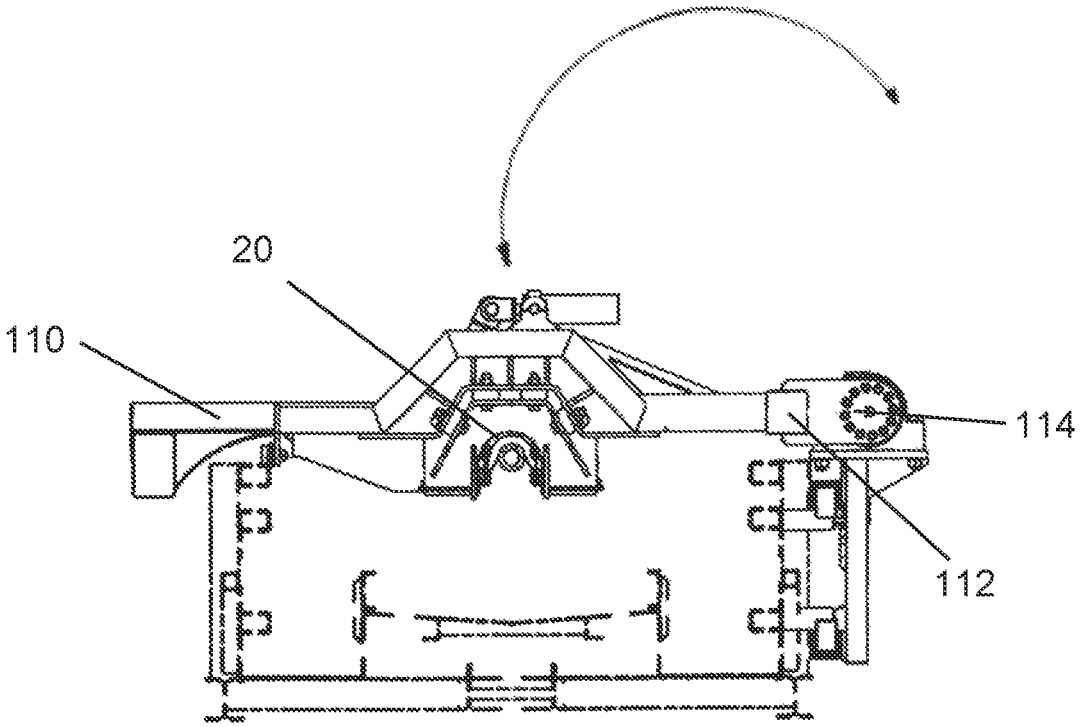
FIG. 20 is a view taken along the lines 20-20 of FIG. 18.

In FIG. 15, feed frame 28 and ramp 30 are shown fully extended. In this position, second end 63 of frame 28 is positioned at or near first end 13 of skid 12, and second 67 of ramp 30 is positioned at or near first end 61 of frame 28. Turning to FIG. 16, there is shown a portion of skid 12 with feed frame 28 and ramp 30 in transport mode. In transport mode, diagonal rollers 72 have been folded down, and ramp 30 has been slidably moved into the interior of frame 28. It is thus apparent that the width of ramp 30 should be smaller than that of frame 28. With respect to frame 28, legs 66 have been retracted and frame 28, along with ramp 30, has been slidably moved into the interior of skid 12. Again, it will be apparent that the width of frame 28 should be smaller than that of skid 12. In the position shown in FIG. 16, the first end 61 of ramp 28, and the first end 65 of ramp 30 are both positioned at or near first end 13 of skid 12. It will again be appreciated that connections, fasteners, tie downs, or the like can be employed to hold the components in position during transport, but such are well known to those skilled in the art and are not discussed in detail.

Turning to FIGS. 17-20, there are shown the pipe wrench 20 and the gripping arm assembly 22. Many of the other features of the present invention are not depicted in FIGS. 17-20, to allow better views of these particular components. Wrench 20 is mounted on wrench arm 110. Wrench arm 110 is connected by linkage 112 to wrench motor 114 which is mounted on wall 16. When wrench motor 114 turns, wrench arm 110 and hence pipe wrench 20 are pivoted around motor 114 (see arrows in FIG. 20). Pipe gripping assembly 22 has a similar configuration. There are plurality of parallel pipe gripping arms 100, each of which has grippers 101 which are operable to selectively grip and release segments of drill pipe or other tubulars. Pipe gripping arms are each attached to linkage bar 102 which in turn is attached to a plurality of arm motors 104. It will be appreciated that the exact number and relative placement of gripping arms 100 can vary. Additionally, the exact number of arm motors 104 can vary. When arm motors 104 rotate, linkage bar 112, and hence, gripping arms 100 are pivoted around motors 104 (see arrows in FIG. 19). The pivoting of pipe wrench 20 and gripping arms 100 allows top drive 24 to move along the length of skid 12 without impediment. Additionally, and as described more fully hereafter, the pivoting of gripping arms 100 is used to remove segments of drill pipe from the drill string.

It will be appreciated that bearings, fasteners, hydraulic/pneumatic lines, power lines, and various other components may be included in the invention. Additionally, controllers, processors, etc. can be employed to control the operation of the various components. Such components and controls are well known to those skilled in the art and are not discussed in detail herein.

In operation, and as seen in FIG. 1, the system 10 is positioned at the exit site of an HDD operation. Screw piles 40 are lowered into the ground to help hold the system 10 in place. The feed frame 28 and ramp 30 are fully extended, and feet 66 and nose 80 rest on the ground. Diagonal rollers 72 are in the raised position. The drill string D exits the borehole of the HDD operation and moves up ramp 30, along feed frame 28, and across the length of skid 12. As will be appreciated by those skilled in the art, the terminal end of drill string D will have a drill bit, steering motor, and possibly other components useful for drilling the initial borehole. Pipe wrench 20 can disconnect the drill bit, steering motor, and any other components which are not segments of drill pipe. While gripping the disconnected drill bit (or other component), pipe wrench 20 is then pivoted by wrench motor 114 to carry the drill bit out of skid 12 where it is released from wrench 20. Pipe wrench 20 is then returned to its normal operating position. Top drive 24 is brought forward, by the retraction of piston rods 46, until top drive 24 can connect to the terminal segment D1 of drill pipe D. Top drive 24 is then moved back to its terminal position near second end 15, pulling drill string D along with it. As top drive 24 returns to its terminal position, it passes over plates 32 which are in their lowered, recessed position. After top drive 24 passes over plates 32, plates 32 are then raised up to support drill string D on rollers 54. To disconnect D1 from the drill string D, pipe wrench 20 grips segment D2 to prevent rotation thereof. Top drive 24 rotates D1 to disconnect it from segment D2. The operation of top drive 24, including the connection to and disconnection from drill pipe segments, is well known to those skilled in the art. Pipe gripping arms 22 then grip segment D1 while top drive 24 disconnects from segment D1. Arm motors 104 cause pipe gripping arms to pivot around their mounting frame, thus lifting segment D1 up (see FIG. 19). Pipe gripping arms 22 continue to pivot until segment D1 is resting on pipe racks 38 at which point segment D1 is released from pipe gripping arms 22. Piston rods 46 then retract, causing carrier 26 to pull top drive 24 along skid 12 into position to connect to pipe segment D2. Plates 32 lower back down as top drive 25 passes over them. Wrench 20 releases pipe segment D2. Top drive 24 then connects to segment D2 and returns to its terminal position, pulling the drill string along.

Mud pump unit 36 can provide any fluids needed throughout the operation of system 10. Mud pump unit 36 can also help return the drilling fluids/mud back to the entrance side of the borehole. In this regard, the mud pump unit is operatively connected to the top drive to pump fluids through the drill string in a manner well known to those skilled in the art. When the drilling is completed, some of the drilling fluid/mud remains in the drill string. When the top drive is connected to the drill string, mud pump unit can pump the residual drilling fluids/mud which remain in the drill string back through the drill string to the entry side of the horizontal directional drilling site for proper handling.

The pipe segment removal process is repeated until all the drill string segments have been removed. If desired, the pipeline, utility cable, or the like which is to be installed (hereafter referred to as installation line) can be connected to the final segment of drill pipe such that as the system 10 of the present invention pulls the drill string out of the borehole, it is pulling the installation line into and through the borehole, thereby simultaneously installing the installation line and removing the drill string.

The present invention provides several advantages over prior art procedures for removing a drill string from a horizontal directional drilling borehole. The present invention ensures that the drill string is maintained at the proper angle as it exits the borehole and allows for a hands-off process which is more efficient and safer than prior art procedures. Additionally, the components of the system can be carried on the skid during transport from one location to another, saving on installation and breakdown of the site.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A system for handling of a drill string and drill pipe segments of said drill string on the exit side of a horizontal directional drilling operation borehole, the system comprising:

an elongate skid having a base, a first side wall, a second side wall, a first end, and a second end;

a pipe wrench mounted to one of said first and second side walls;

at least one pipe gripping arm pivotally mounted to one of said first and second side walls;

a top drive mounted on a top drive carrier, said top drive carrier being operative to carry said top drive longitudinally along said skid;

a plurality of piston rods, each of said piston rods having a first end connected to a piston disposed within a piston cylinder, and a second end connected to said top drive carrier, whereby said top drive carrier is moved along said skid by the retraction and extension of said piston rods into and out of said piston cylinders;

whereby said top drive can connect to a segment of said drill pipe forming a drill string and through movement of said top drive carrier, pull said drill string out of said borehole, and whereby said top drive and wrench are operative to disconnect segments of drill pipe from said drill string;

a frame having a first side wall, a second side wall, a first end, and a second end, the second end of said frame being positioned proximate said first end of said skid, there being at least one idler roller mounted on said frame; and a ramp having a first side wall, a second side wall, a first end, and a second end, the second end of said ramp being pivotally connected to said first end of said frame, there being at least one idler roller mounted on said ramp and at least one pair of diagonal rollers mounted on said ramp.

2. The system of claim 1, further comprising:

a pair of legs connected to said second end of said frame, said legs being adjustable in height.

3. The system of claim 1, wherein said diagonal rollers are foldable from a raised position to a lowered position.

4. The system of claim 3, wherein said ramp is nestable within said frame during transport of said system, and wherein said frame is nestable within said skid during transport of said system, whereby, said first end of said ramp and said first end of said frame are both positioned near said first end of said skid during transport of said system.

5. The system of claim 1, further comprising at least one plate mounted in said base, said plate being operatively to selectively raise and lower at least one end of said plate, there being an idler roller mounted on said at least one end of said plate.

6. The system of claim 1, further comprising an operator cabin pivotally mounted to one of said first and second side walls of said skid, said cabin able to pivot to rest atop said skid during transport of said system.

7. The system of claim 1, wherein said pipe wrench is carried on a wrench arm which is pivotally mounted to one of said first and second side walls, a wrench motor being connected to said wrench arm and being operative to cause said wrench arm to lift said wrench up and away from said skid.

8. The system of claim 1, wherein said at least one pipe gripping arm is carried on a linkage bar which is pivotally mounted to one of said first and second side walls, a gripping motor being connected to said linkage bar and being operative to cause said linkage bar to lift said pipe gripping arm up and away from said skid.

9. The system of claim 8, wherein there are a plurality of pipe gripping arms carried on said linkage bar, whereby said gripping motor is operative to cause said linkage bar to lift said plurality of pipe gripping arms up and away from said skid.

10. The system of claim 1, wherein said top drive carrier comprises a mounting bar connected to said piston rods and a plurality of wheels.

11. The system of claim 1, further comprising a mud pump unit.

12. The system of claim 11, wherein said mud pump unit is operative to pump drilling fluids through a drill string extending from said exit side of said horizontal drilling site to return said drilling fluids to an entry side of said horizontal drilling site.

13. A method of removing a segment of drill pipe from a drill string on the exit side of a horizontal directional drilling operation borehole in which the drill string has exited the borehole, the drill string comprising a plurality of segments of drill pipe, the method comprising:

providing drill pipe handling system, the system comprising:

an elongate skid having a base, a first side wall, a second side wall, a first end, and a second end;

a pipe wrench mounted to one of said first and second side walls;

at least one pipe gripping arm pivotally mounted to one of said first and second side walls;

a top drive mounted on a top drive carrier, said top drive carrier being operative to carry said top drive longitudinally along said skid;

a plurality of piston rods, each of said piston rods having a first end connected to a piston disposed within a piston cylinder, and a second end connected to said top drive carrier, whereby said top drive carrier is moved along said skid by the retraction and extension of said piston rods into and out of said piston cylinders;

a frame having a first side wall, a second side wall, a first end, and a second end, the second end of said frame being positioned proximate said first end of said skid, there being at least one idler roller mounted on said frame; and a ramp having a first side wall, a second side wall, a first end, and a second end, the second end of said ramp being pivotally connected to said first end of said frame, there being at least one idler roller mounted on said ramp and at least one pair of diagonal rollers mounted on said ramp;

carrying said top drive using said top drive carrier into a position away from said second end of said skid;

connecting said top drive to a first segment of drill pipe forming said drill string;

carrying said top drive using said top drive carrier to a terminal position proximate said second end of said skid, whereby said drill string is pulled along with said top drive;

gripping a second segment of drill pipe forming said drill string with said pipe wrench;

disconnecting said first segment of drill pipe from said second segment of drill pipe using said top drive;

gripping said first segment of drill pipe with said at least one pipe gripping arm;

pivoting said at least one pipe gripping arm such that it lifts said first segment of drill pipe away from said skid;

releasing said first segment of drill pipe.

14. The method of claim 13, further comprising:

providing a mud pump unit operative to pump fluids;

pumping drilling fluid used during said horizontal directional drilling operation through said drill string back to an entry side of said horizontal directional drilling borehole.

* * * * *